US006034314A

United States Patent [19]

Koike

[11] Patent Number: 6,034,314

[45] Date of Patent: Mar. 7, 2000

[54] AUTOMATIC PERFORMANCE DATA CONVERSION SYSTEM

[75] Inventor: Masahiko Koike, Hamamatsu, Japan

[73] Assignee: Yamaha Corporation, Hamamatsu, Japan

[21] Appl. No.: 08/918,312

[22] Filed: Aug. 26, 1997

[30] Foreign Application Priority Data

Aug. 29, 1996 [JP] Japan ..... 8-228843

[51] Int. Cl.[7] ..... G10H 7/00

[52] U.S. Cl. ..... 84/600; 84/609; 84/645

[58] Field of Search ..... 84/600, 645, 609

[56] References Cited

U.S. PATENT DOCUMENTS

| | | | |
|---|---|---|---|
| 5,119,711 | 6/1992 | Bell et al. | 84/645 X |
| 5,668,337 | 9/1997 | Kondo et al. . | |
| 5,734,119 | 3/1998 | France et al. | 84/645 X |
| 5,824,935 | 10/1998 | Tanaka | 84/645 X |
| 5,831,192 | 11/1998 | Watari et al. | 84/600 |

FOREIGN PATENT DOCUMENTS

| | | |
|---|---|---|
| 0 597 381 | 5/1994 | European Pat. Off. . |
| 5-188 941 | 7/1993 | Japan . |

*Primary Examiner*—Jeffrey Donels
*Attorney, Agent, or Firm*—Graham & James LLP

[57] ABSTRACT

An automatic performance data conversion system having: a storage unit for storing a rule for converting automatic performance data from a first type into a second type, the rule indicating a correspondence between data strings of the automatic performance data of the first and second types; an input unit for inputting the automatic performance data of the fist type; a data converting unit for converting the automatic performance data from the first type into the second type by rearranging a data string contained in the automatic performance data of the first type input by the input unit in accordance with the rule; and an output unit for outputting the automatic performance data of the second type converted by the data converting unit.

39 Claims, 6 Drawing Sheets

AUTOMATIC PERFORMANCE DATA CONVERSION SYSTEM

BACKGROUND OF THE INVENTION a) Field of the Invention

The present invention relates to automatic performance data conversion techniques, and more particularly to automatic performance data conversion techniques for converting automatic performance data of one type into another type.

b) Description of the Related Art

Musical instrument digital interface (MIDI) data is standardized musical performance data capable of being used commonly by electronic musical instruments. GM standard is a fundamental standard (high level standard) of MIDI data. The GM standard determines only basic rules of musical performance data. Standards defining the details of the GM standard are GS and XG standards. Although both the GS and XG standards are in conformity with the GM standard, they have some difference in details. For example, some of tone color numbers of the two standards are different and some kinds of effect or effect parameters are different.

Electronic musical instruments and sound sources have been prepared independently for GS standard use and XG standard use. For example, if MIDI data of the GS standard is supplied to an electronic musical instrument of the XG standard, sounds may be reproduced in unexpected tone colors and effects.

Karaoke sing-along machines in communications use are now prevailing widely. If a new musical program is to be supplied to a karaoke sing-along machine, automatic performance data of this musical program is generated and transmitted over a network to the machine. As the number of musical programs increases, the amount of automatic performance data increases. Since automatic performance data for new musical programs has been generated one after another in a karaoke communication field, there is a large stock of automatic performance data available in this field.

Automatic performance data used by karaoke communications is mainly constituted of MIDI data. There are two types of MIDI data, GS standard MIDI data and XG standard MIDI data. Correspondingly, there are two types of automatic performance data, GS standard and XG standard types.

For example, if automatic performance data of the GS standard is reproduced with a karaoke sing-along machine of the XG type, the musical program cannot be reproduced properly because of a difference between tone color arrays or the like, and performance inherent to its musical program cannot be expected. Even if a large amount of automatic performance data of one standard is in possession, a karaoke sing-along machine of another standard cannot reproduce it and the resources of such automatic performance data becomes wasteful.

If the standard of MIDI data or automatic performance data is different, electronic musical instruments or karaoke sing-along machines may produce unexpected sounds, and in some cases combinations of these machines and data cannot be used in practice. Even a large amount of MIDI data or automatic performance data stocked from the past to date cannot be used with electronic musical instruments and karaoke sing-along machines of a different standard, and is left in vain.

SUMMARY OF THE INVENTION

It is an object of the present invention to provide an automatic performance data conversion system, automatic performance data conversion method, and media storing conversion programs, capable of converting automatic performance data of one type into another type.

According to one aspect of the present invention, there is provided an automatic performance data conversion system comprising: storage means for storing a rule for converting automatic performance data from a first type into a second type, the rule indicating a correspondence between data strings of the automatic performance data of the first and second types; input means for inputting the automatic performance data of the fist type; data converting means for converting the automatic performance data from the first type into the second type by rearranging a data string contained in the automatic performance data of the first type input by the input means in accordance with the rule; and output means for outputting the automatic performance data of the second type converted by the data converting means.

A rule for converting automatic performance data from the first type into the second type is stored in the storage means. A user or a maker can form or change the rule. Since a user or a maker can freely form or change the rule, the conversion rule of automatic performance data can be determined with ease and the degree of freedom of automatic performance data conversion can be widened. Not only conversion of numerical values but also rearrangement of data strings of automatic performance data can be performed by using the rule. Since a user or a maker can freely form or change the rule, complicated conversions can be executed.

According to a further aspect of the present invention, there is provided an automatic performance data conversion system comprising: input means for inputting automatic performance data of a first type; data converting means for converting the automatic performance data of the first type input by the input means into automatic performance data of a second type by converting effect imparting data contained in the automatic performance data of the first type; and output means for outputting the automatic performance data of the second type converted by the data converting means.

Effect imparting data contained in automatic performance data can also be converted into a different type. Even if there is no compatibility of effect imparting data between the automatic performance data of the first and second types, it is possible to properly convert the effect imparting data. If the automatic performance data with the converted effect imparting data is supplied to an effect imparting apparatus, proper effects can be added to musical tone signals.

According to a still further aspect of the present invention, there is provided an automatic performance data conversion system comprising: input means for inputting automatic performance data of a first type; data converting means for converting the automatic performance data of the first type input by the input means into automatic performance data of a second type by dividing a single channel information piece contained in the automatic performance data of the first type into a plurality of channel information pieces; and output means for outputting the automatic performance data of the second type converted by the data converting means.

Although one channel information piece is sufficient in the converting automatic performance data, a plurality of channel information pieces are sometimes required in the converted automatic performance data. In such a case, the single channel information piece in the converting automatic performance data of the first type is divided into a plurality of channel information pieces to generate the automatic performance data of the second type. By dividing into a plurality of channel information pieces, the automatic performance data of the second type can be properly played.

DETAILED DESCRIPTION OF THE PREFERRED EMBODIMENTS

Figure 1:
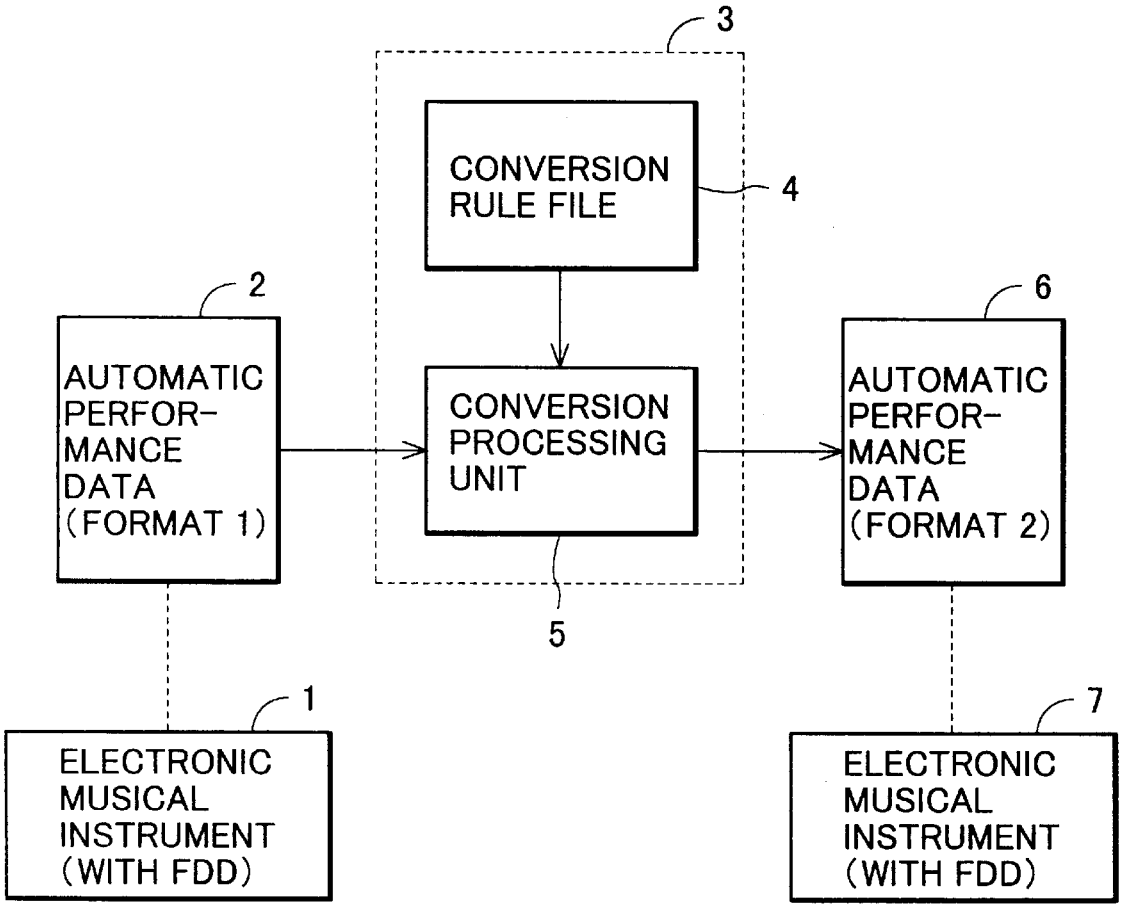
FIG. 1 is a conceptual diagram showing the overall structure of an automatic performance data conversion system according to an embodiment of the invention.

FIG. 1 is a conceptual diagram showing the overall structure of an automatic performance data conversion system according to an embodiment of the invention.

Automatic performance data 2 of a first type is converted into automatic performance data 6 of a second type by a computer 3. The computer 3 has a conversion rule file 4 for storing conversion rules, and a conversion processing unit 5. The conversion processing unit 5 converts the automatic performance data 2 into the automatic performance data 6 in accordance with rules stored in the conversion rule file 4. The computer 3 may be a general computer such as a personal computer or may be replaced by a dedicated converter unit.

The automatic performance data 2 of the first type can be reproduced (played) with an electronic musical instrument 1 of a first type. The automatic performance data 6 of the second type can be reproduced (played) with an electronic musical instrument 7 of a second type.

The automatic performance data 2 of the first type can be reproduced (played) correctly with the electronic musical instrument 1 of the first type, but not with the electronic musical instrument 7 of the second type. Similarly, the automatic performance data 6 of the second type can be reproduced (played) correctly with the electronic musical instrument 7 of the second type, but not with the electronic musical instrument 1 of the first type.

The electronic musical instruments 1 and 7 each have a floppy disk drive (FDD) so that the automatic performance data 2 or 6 can be stored in a floppy disk capable of being loaded to or unloaded from FDD. For example, the automatic performance data 2 used by the electronic musical instrument 1 is stored in a first floppy disk and this disk is loaded to the computer 3. The computer 3 reads the automatic performance data 2 stored in the first floppy disk and writes it in a second floppy disk. If the second floppy disk written with the automatic performance data 6 is loaded to the electronic musical instrument 7, this instrument can correctly play the automatic performance data 6.

Figure 2:
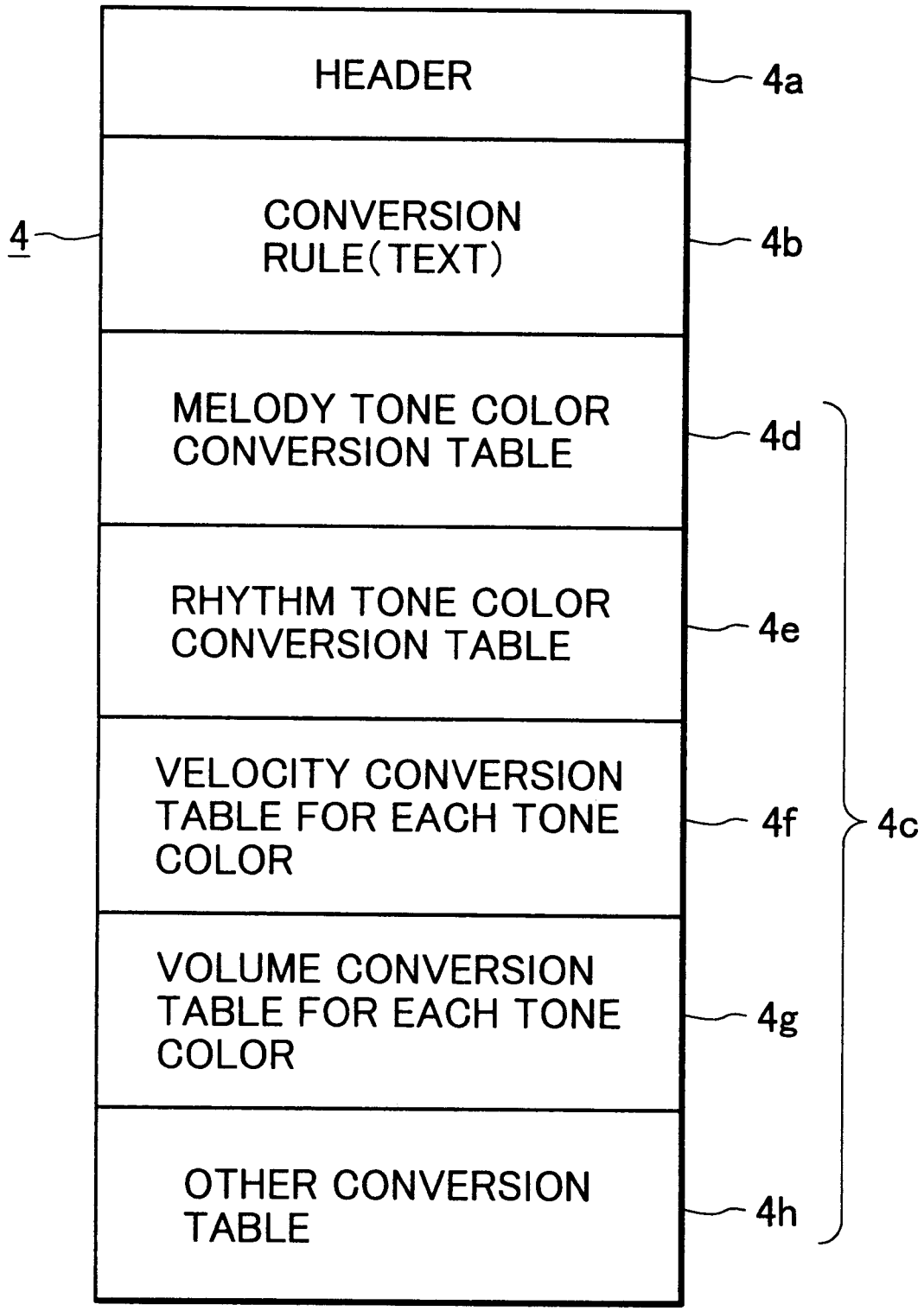
FIG. 2 is a diagram showing the contents of a conversion rule file shown in FIG. 1.

FIG. 2 is a diagram showing the contents of the conversion rule file 4 shown in FIG. 1.

The conversion rule file 4 includes a header 4*a*, conversion rules 4*b*, and conversion tables 4*c*. The header 4*a* stores information necessary for file conversion, such as a converting type name, a converted type name, a file name, and a file formed date.

The conversion tables 4*c* include: a melody tone color conversion table 4*d* for converting a tone color number of a melody tone color (except a rhythm tone color); a rhythm tone color conversion table 4*e* for converting a tone color name of a rhythm tone color (except a melody tone color); a velocity conversion table 4*f* for converting velocity data (initial touch) for each tone color; a volume conversion table 4*g* for converting volume (sound intensity) for each tone color; and other conversion tables 4*h* for other conversions.

The conversion tables 4*c* convert data values. Conversion of a data type (data representation method) is executed by using the conversion rules 4*b* to be described later. If the value of data only is to be converted, this conversion can be executed with ease by using the conversion tables 4*c*. For example, a program change (tone color number) and a velocity (initial touch) during a note on-event can be converted with ease by using the conversion tables 4*c*.

The conversion tables 4*c* are used for basic conversions which are performed in most cases. Therefore, a maker or a supplier of automatic performance data may prepare these conversion tables 4*c*. In this case, a user can edit or change the conversion tables 4*c* produced by the maker or supplier so as to make the rules match the user's preference. A user may generate conversion tables by himself or herself.

The conversion rules 4*b* can be written with a low level programming language of a text format, and are used for executing highly sophisticated conversions which can not be executed by the conversion tables 4*c*. For example, conversion between data of different types (different representation methods) is executed.

For example, a conversion rule 4*b* executes conversion of effect imparting data. Sound effect includes reverb, phaser (phase modulator), vibrato, pitch change, and the like. The number of these effects (reverb, phaser, etc.), the effect parameters and the like change depending on the type of sound source and the like.

An effect imparting apparatus is often provided with an extended function specific to each standard. Effect data in automatic performance data has therefore a different code (data) system corresponding to each specific extended function.

If the code system is different, it is difficult for the conversion tables 4*c* to conduct conversions. In this case, therefore, conversions are executed by using the conversion rules 4*b*. The conversion rules 4 can execute complicated conversions between different code systems. A maker or a user can write a conversion rule 4*b* with a low level programming language. Examples of the format of a conversion rule 4*b* are given in the following.

$$\text{Data?=length1, data1 . . . , type, length2, data2 . . . [,length3, data3 . . . ]} \quad (1)$$

The symbol "?" represents a conversion rule number, and length1, length2 and length3 each represent a length of each of the data string data1 . . . , data2 . . . , and data3 . . . . The term "type" represents the kind of conversion. The details of "type" will be given later. The contents in [ ] indicate a format which may be omitted.

The equation (1) is a rule for converting a data string data1 . . . into a data string data2 . . . . If automatic performance data contains the data string data1 . . . , this data string is converted into the data string data2 . . . .

If "type" is 0, data1 . . . is unconditionally converted into data2 . . . . If "type" is 1, data1 . . . is basically converted into data2 . . . . However, if conversion from data1 . . . into data2 . . . cannot be executed normally, data1 . . . is converted into data3 . . . . The data string data3 . . . is, for example, an error code.

Next, specific examples of the conversion rule for effect data will be given. It is assumed that there are two types of automatic performance data, a first type (type 1) and a second type (type 2). A data string of each type is given in the following. The invention is not limited only to the following types but conversion between other types may be executed.

Type 1: aa, CH, bb, Eff-type, Param-byte, Param . . .

Type 2: cc, CH, Eff-type(MSB), Eff-type(LSB), Param-byte, Param . . . (2)

CH represents a channel number to which an effect is imparted, Eff-type represents the type of effect, Param represents a parameter (variable length) designated for each effect, Param-byte represents the number of bytes of a variable length parameter Param, and aa, bb and cc represent constants. MSB is a most significant byte, and LSB is a least significant byte.

For the conversion of automatic performance data of the type 1 into automatic performance data of the type 2, the following rule is written in a conversion rule file in the text format in accordance with the format of the equation (1). REG1 and REG2 represent variable registers. If data is a variable, these registers REG1 and REG2 can be used. The same register indicates the same variable.

Data1=6, aa, REG1, bb, 1, 1, REG2, 0, 6, cc, REG1, 0, 1, 1, REG2:RevTbl (3)

The relationship between the equations (1) and (3) will be described. The data string data1 . . . of the type 1 is "aa, REG1(=CH), bb, 1(=Bff-type), 1(=Param-byte), REG2(=Param)", and the length1 of the data string data1 . . . is 6 bytes.

The data string data2 . . . of the type 2 is "cc, REG1(=CH), 0(=Bff-type(MSB))), 1(=Bff-type(LSB)), 1(=Param-byte), REG2:RevTbl(=Param)", and the length2 of the data string data2 . . . is 6 bytes. The channel number CH is considered as a variable and the register REG1 is used.

The equation (3) shows a conversion rule when reverb is designated as the type of effect. Reverb is represented by Eff-type=1 for the type 1, and Eff-type(MSB)=0, Bff-type (LSB)=1 for the type 2.

It is not efficient to form a conversion rule for each value of the parameter Param . . . of reverb. Param . . . is considered as a variable and the register REG2 is used for the conversion. The parameter Param . . . can be processed in most cases by converting each value thereof. In this example, the parameter (e.g., reverb level) of the type 1 is converted into the parameter of type 2 by the conversion table RevTbl. A representation REG2:RevTbl means reference to a RevTbl by using the value REG2 as an index.

In the equation (3), type=0. This means conversion from the type 1 into the type 2.

If type=1, the data string data1 of the type 1 is converted into another data string data3 if the data1 of the type 1 cannot be converted normally into the data string data2 of the type 2.

For example, there is a case wherein the numbers of parts are different which parts can be logically processed between two types of automatic performance data. If the numbers of parts are the same, conversion can be performed without problem. However, if the numbers of parts are different, parts which cannot be assigned are partially left. In this case, conversion is performed in such a manner that specific codes (error codes) not affecting musical performance are filled to allow such parts to be identified. A user searches these specific codes by using a computer or a sequencer and edits them.

As above, by writing the conversion rule 4*b* with a low level programming language of a text format, a data string can be converted which is difficult or unable to be converted by using the conversion table 4*c* only. Complicated conversions become possible by forming the conversion table 4*a* and conversion rule 4*b*.

For example, a tone color number can be converted by using the conversion table 4*c* because only a value thereof is converted without changing the code system. However, for the conversion of effect data and the like, conversion of the code system becomes necessary. In this case, therefore, the conversion rule 4*b* is used. Conversion of effect data and the like is complicated and the conversion table 4*c* only cannot convert it. If the conversion rule 4*b* is used, effect data and the like can be converted.

The conversion rule 4*b* can be written efficiently by using the registers REG1 and REG2 or table RevTbl.

Figure 3:
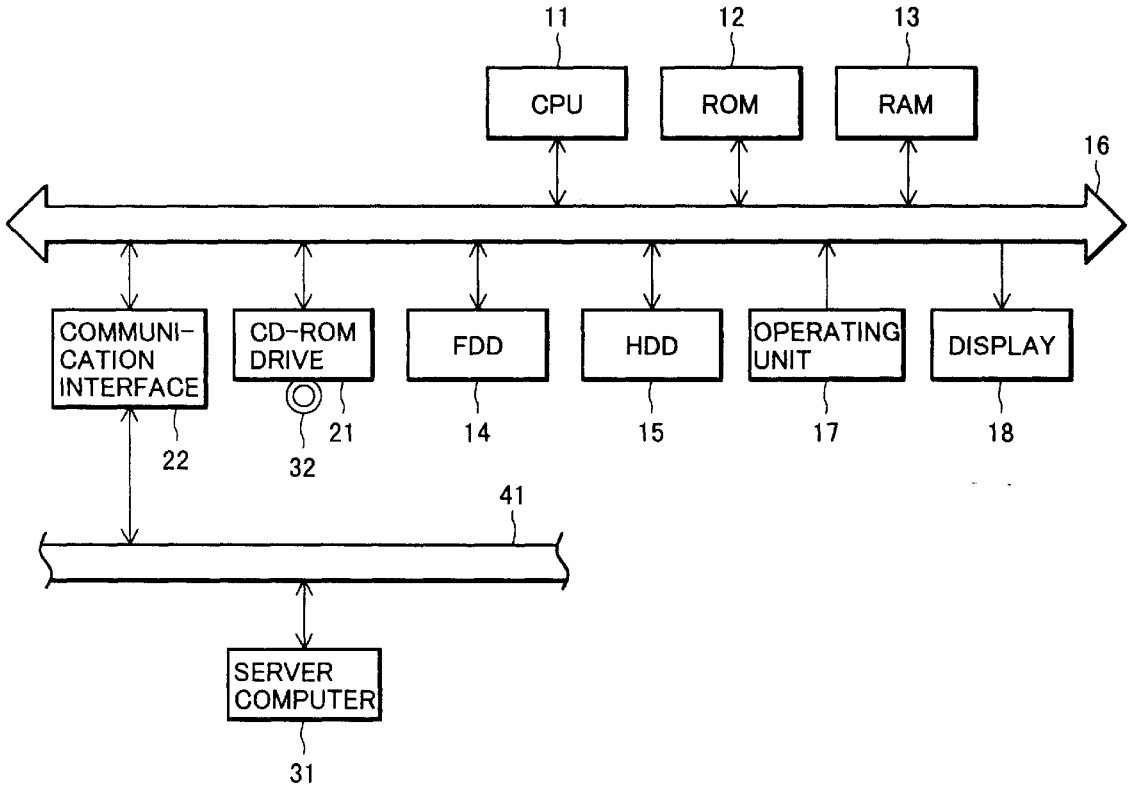
FIG. 3 is a diagram showing the hardware structure realizing the automatic performance data conversion system of the embodiment.

FIG. 3 is a diagram showing the hardware structure realizing the automatic performance data conversion system of this embodiment.

A bus 16 is connected to a CPU 11, a ROM 12, a RAM 13, a communication interface 22, a CD-ROM (compact disk read only memory) drive 21, a floppy disk drive (FDD) 14, a hard disk drive (HDD), an operating unit 17 and to a display 18.

The floppy disk drive 14 or hard disk drive 15 is used for storing converting and converted automatic performance data. If automatic performance data of the first and second types are both in conformity with the standard MIDI file format, the automatic performance data of the two types can be stored in one floppy disk. This floppy disk storing the automatic performance data of both the types can be used by both the electronic musical instruments 1 and 7 shown in FIG. 1.

A list of files of automatic performance data stored in a floppy disk or hard disk loaded in the floppy disk drive 14 or hard disk drive 15 can be displayed on the display 18. A user can select a desired file to be converted, from the list of files by using the operating unit 17. The automatic performance data of the converted type (standard) can be selected or loaded by using the operating unit 17.

ROM 12 stores therein computer programs and various parameters. CPU 11 controls the floppy disk drive 14 and the like and executes data conversion and other tasks in accordance with computer programs stored in ROM 12. RAM 13 has a working area of CPU 11 including registers, flags and buffers.

The conversion rule file 4 is stored in a floppy disk of the floppy disk drive, a hard disk of the hard disk drive 15, ROM 12 or RAM 13. In order to execute data conversion at high speed, it is preferable to store the conversion rule file in RAM 13 or ROM 12. However, for rewriting the conversion rules, it is preferable to store the conversion rules in RAM 13.

If conversion rules are to be stored for a long period, they are stored in a floppy disk or hard disk, and transferred to RAM 13 only when data is converted.

HDD 15 is used for storing various data of operation programs, automatic performance data, and conversion rule files. If the operation programs are not stored in ROM, they are stored in a hard disk of HDD 15 and read into RAM 13 so that CPU 11 can operate in the same manner as they are stored in ROM 12. In this manner, addition and version-up of operation programs become easy. The CD-ROM drive 21 reads various data and operation programs stored in a CD-ROM 32. The read operation programs and various data are stored in a hard disk of HDD 15. In this manner, new installation, version-up and the like of operation programs become easy. In addition to the CD-ROM drive 21, other types of media such as a magnetooptical (MO) drive may also be used.

The communication interface 22 is connected to a server computer 31 via a communication network such as a LAN (local area network), Internet, and a telephone line. If the operation programs and various data are not stored in a hard disk of HDD 15, they are down-loaded from the server computer 31. The automatic performance data conversion system as a client transmits a command of requesting the operation programs and data to the server computer 31 via the communication interface 22 and communication network 41. Upon reception of this command, the server computer 31 transmits the requested operation programs and data to the automatic performance data conversion system via the communication network 41. The automatic performance data conversion system receives the programs and data via the communication interface 22 and stores them in a hard disk in HDD 15 to complete down-load.

This embodiment may be practiced by a commercially available personal computer or the like installed with such operation programs and various data. In this case, the operation programs and various data may be supplied to users by storing them in computer readable recording media such as CDROMs and floppy disks. If personal computers connected to the communication network such as a LAN, Internet, and a telephone line are used, the operation programs and various data may be supplied to the computers via the communication network.

Figure 4:
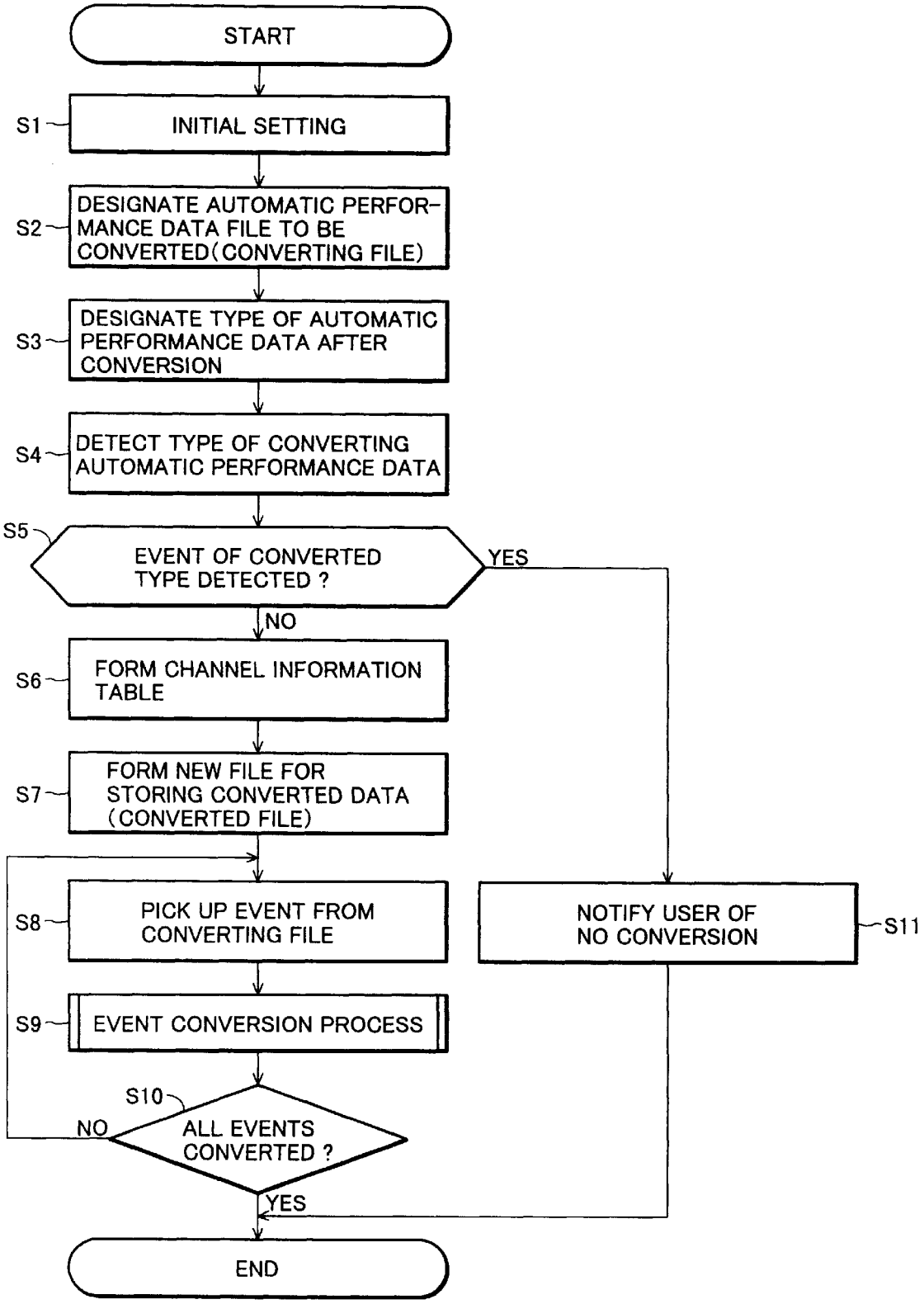
FIG. 4 is a flow chart illustrating a main routine to be executed by a CPU shown in FIG. 3.

FIG. 4 is a flow chart illustrating the main routine to be executed by CPU 11 shown in FIG. 3.

At Step S1, initializing is executed for registers, flags, buffers and the like. For example, a tone color bank number is initialized to "0". A tone color is generally designated by a combination of a bank number (bank select) and a program number (program change). For example, twelve tone colors are set to one bank, and each tone color in the bank is selected by a program change. If a tone color is designated only by a program change (program number) without the bank number, the bank number is assumed to be "0". The bank number "0" is assigned to a bank of standard melody tone colors.

At Step S2, an automatic performance data file to be converted (hereinafter called converting file) is designated. All files of the automatic performance data stored in a floppy disk or hard disk in the floppy disk drive or HDD are displayed on the display. A user selects a desired one of the displayed files to be converted, by using the operating unit.

At Step S3 the type of the automatic performance data after conversion is designated. The type is, for example, the GS standard and XG standard. All types are displayed on the display and a user selects one of them by using the operating unit. A user may enter the type name by the operating unit.

At Step S4 the type of the automatic performance data to be converted is detected. The type is, for example, the GS standard and XG standard. An event in the automatic performance data may be read to identify the type of the event and to detect the type of the automatic performance data.

For example, the header of the automatic performance data of the XG standard contains a reset signal of the XG standard, whereas the header of the automatic performance data of the GS standard contains a reset signal of the GS standard. By discriminating the reset signals, the type of the automatic performance data can be identified whether it is XG or GS standard. The reset signal is a kind of event.

At Step S5 it is checked whether Step S4 detected an event of the same type as that after conversion. At the preceding Step S4, the type of the automatic performance data after conversion was detected. Therefore, if the converting type is the same as the converted type designated by the user, it is not necessary to execute conversion and if this conversion is forcibly performed, abnormal data may be generated.

If the converting type is the same as the converted type, at Step S11 a notice of no conversion is displayed on the display to notify the user. Thereafter, the main routine is terminated.

On the other hand if the converting type is different from the converted type, data conversion is executed so that the routine advances to Step S6.

At Step S6, a channel information table is formed. Specifically, the automatic performance data is read from the converting file to check channel numbers used. All channel numbers used by the converting automatic performance data are registered in the channel information table.

At Step S7 a file (hereinafter called converted file) for storing converted data is newly formed and only the header is written in this new converted file. The automatic performance data is written later in this file.

At Step S8 an event is read from (picked up from) the converting file. At Step S9 the read event is subjected to data conversion. The event of the converting type is converted into an event of the converted type and written in the converted file. The details of this process will be described later with reference to the flow charts shown in FIGS. 5 and 6.

At Step S10 it is checked whether data conversion of all events in the converting automatic performance data has been completed. If not completed, the routine returns to Step S8 to repeat the processes for the next event.

If all events are completed, the main routine is terminated. All the automatic performance data of the converting type is therefore converted into the automatic performance data of the converted type.

Figure 5:
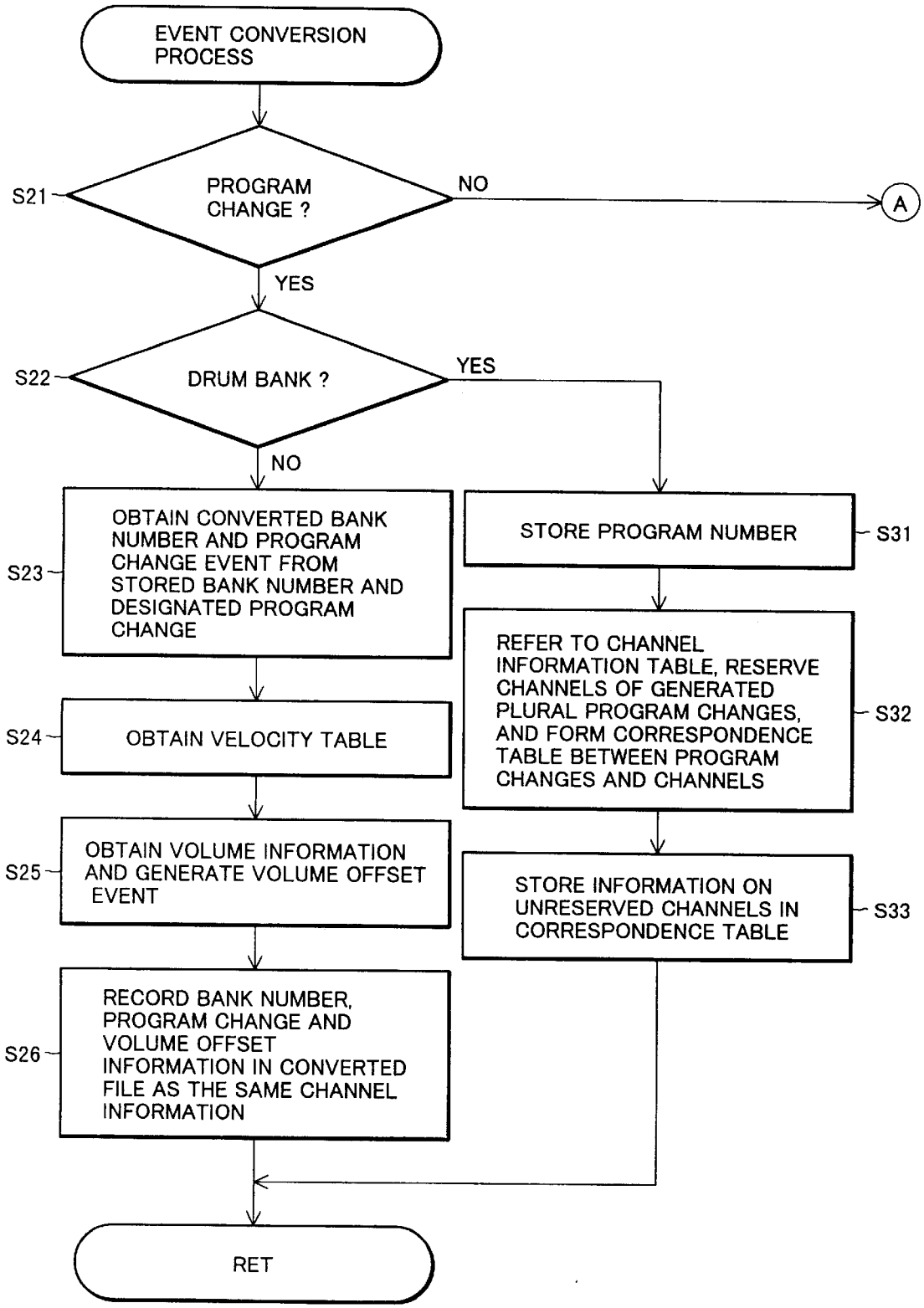
FIG. 5 is a flow chart illustrating the details of an event conversion process at Step S9 shown in FIG. 4.
Figure 6:
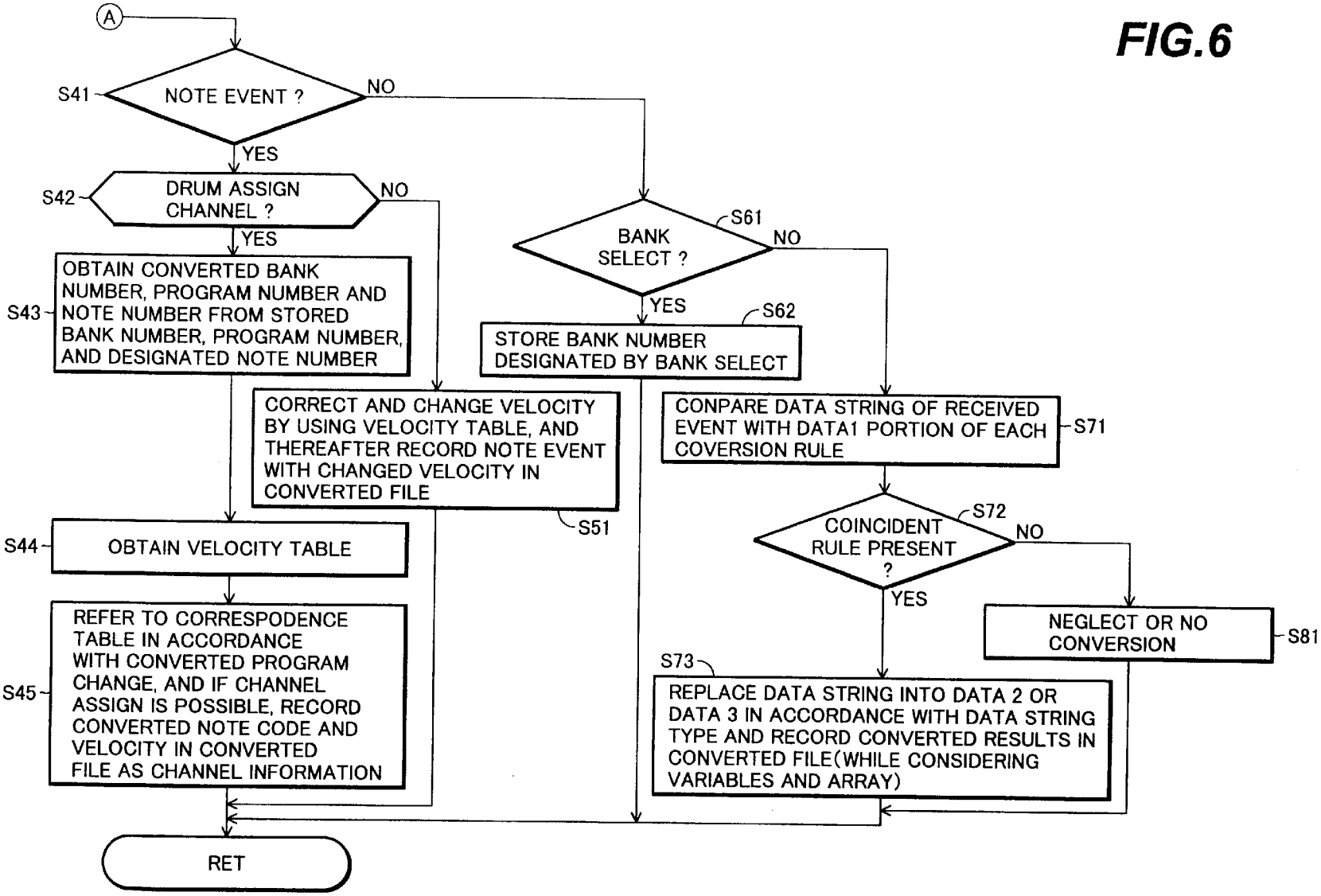
FIG. 6 is a flow chart following the process shown in FIG. 5.

FIGS. 5 and 6 are flow charts illustrating the details of the event conversion process at Step S9 shown in FIG. 4.

Tone colors of automatic performance data are broadly classified into the following two kinds.

[1] Melody tone color

[2] Drum tone color

Events of each of the above tone colors are usually arranged in the following order.

(1) Bank select (2) Program change (3) Note event

Other information (e.g., effect) if necessary is also present.

First, the process for the melody tone color will be described, and then the process for the drum tone color will be described.

[1] Melody Tone Color (1) Bank Select

It is assumed that an event of a bank select is read from the converting file. If the read event is a bank select, the flow advances to Step S62 via Steps S21, S41 and S61.

At Step S62 the bank number designated by the bank select is stored. This bank number is stored in an internal register only and not stored in the converted file. Thereafter, the process returns to the main routine (FIG. 4).

The tone color number is designated by a combination of a bank number (bank select) and a program number (program change). The program number includes "0" to "127" representing tone colors of 128 kinds. For a different bank number, there are different tone colors (128 tone colors) with program numbers "0" to "127". The bank number is designated by two bytes including a most significant byte (MSB) and a least significant byte (LSB).

(2) Program Change

It is assumed that a program change is read from the converting file. If the read event is a program change, the flow advances to Step S22 via Step S21.

At Step S22 it is checked whether the bank number designated by the bank select is a drum bank or a melody band. The drum bank contains drum tone colors and the melody bank contains melody tone colors. For example, if the bank number MSB is 7F in hexadecimal notation, this bank is a drum bank. If the bank number MSB takes a different value, this bank is a melody bank. There is a case, however, wherein some tone color belongs to the drum bank in the automatic performance data of one type, and to the melody bank in the automatic performance data of another type.

In this example, the bank number is assumed as indicating the melody tone color. The bank is not the drum bank in the case of the melody tone color so that the flow advances to Step S23.

At Step S23 the bank number and program number after conversion are acquired in accordance with the stored bank number (S62) and the program number designated by the program change.

Specifically, the bank number and program number are acquired in accordance with the converting bank number and program number, by referring to the melody tone color conversion table 4*d* (FIG. 2). The melody tone color conversion table 4*d* stores correspondence between bank numbers and program numbers.

At Step S24, in accordance with the stored bank number (S26) and designated program number, a velocity table for the corresponding tone color is obtained. The velocity corresponds to an initial touch (key depression velocity) or sound volume if a keyboard is used. The velocity table therefore corresponds to a touch curve. Generally, the larger the key depression velocity, the greater the sound is produced.

The initial touch (velocity) changes with each keyboard (each keyboard maker). In most cases, therefore, the velocity changes with the type of automatic performance data.

The converted velocity is therefore obtained in accordance with the converting velocity by referring to the velocity conversion table 4*f* (FIG. 2) provided for each tone color. This velocity conversion table 4*f* stores correspondence between velocities of automatic performance data of the two types.

At Step S25, in accordance with the stored bank number (S62) and designated program number, volume information corresponding to the tone color is obtained to generate a volume offset event. As different from the velocity, the volume indicates a sound level as a total (average sound level). The volume offset event is an event for setting a volume offset value.

The volume has the characteristics specific to the type of automatic performance data. Namely, the volume becomes different from one type to another of automatic performance data. For example, if a relatively large volume is set to a piano as compared to another tone color in a sound source produced by one company, the automatic performance data is produced by taking this feature into consideration.

Therefore, in accordance with the converting volume, the converted volume is obtained with reference to the volume conversion table 4*g* (FIG. 2) for the subject tone color. The volume conversion table 4*g* stores correspondences between converting and converted volumes for the subject tone color.

Since both the velocity and volume are sound level information, both of them may be converted collectively at a time. However, since the velocity and volume have different properties as described above, the conversion tables can be formed easily if they are converted separately.

At Step S26 the converted file is recorded with the bank number (bank select), program number (program change) and volume offset information respectively as the same channel information. In this manner, the converted file is written with the converted tone color information and volume information. Thereafter, the flow returns to the main routine (FIG. 4).

Although the tone color is designated by a combination of a bank number and a program number, it may be designated only by the program number (program change) if the bank number is the same as the preceding one. However, there is a case wherein a tone color with some bank number of converting automatic performance data is converted into tone colors with two or more bank numbers in the converted automatic performance data. In order to deal with such a case, at Step S26 both the bank number and program change are recorded.

The velocity table (S24) which will be later detailed is used for correcting the velocity in the note event when it is read (S51).

(3) Note Event

It is assumed that a note event is read from the converting automatic performance data. If the read event is a note event, the flow advances to Step S42 via Steps S21 and S41.

At Step S42 it is checked whether the channel of the read note event is a drum assign channel, i.e., it is checked whether the channel assigned to the note event is set to the drum tone color. Specifically, a list of drum assign channels is formed as a table at Step S32 to be described later, and with reference to this table, it is checked whether the channel is a drum assign channel.

In this example, the melody tone color is assumed as being assigned. In the case of the melody tone color, the flow advances to Step S51 because the channel is not a drum assign channel.

At Step S51, after the velocity of the note event is corrected and changed in accordance with the velocity table obtained at Step S24, the note event inclusive of the changed velocity is recorded in the converted file. This procedure will be detailed.

The velocity table for the corresponding tone color has been obtained at Step S24. The note event includes the velocity. The velocity in the note event is converted with reference to the velocity table and the note event inclusive of the converted velocity is recorded in the converted file. Thereafter, the flow returns to the main routine (FIG. 4).

(4) Others (e.g., effect imparting)

Other events include, for example, an effect imparting event. This effect imparting event is represented by a data string written by the equation (2). In accordance with the conversion rule given by the equation (3), the type 1 is converted into the type 2.

It is assumed that a different event other than the above events is read from the converting file. If the read event is a different event, the flow advances to Step S71 via Steps S21, S41 and S61.

At Step S71 the data string of the read (received) event is compared with the data1 part of each conversion rule. The conversion rules 4*b* have been stored in the conversion rule file 4 shown in FIG. 2. Each conversion rule is written in the format given by the equation (1). Data1 in the equation (1) is a converting data string. Since the conversion rule file 4 stores one or two or more conversion rules 4*b*, the data string is compared with the data1 part of each conversion rule to search a corresponding conversion rule.

At Step S72 it is checked whether the data1 part has a coincident conversion rule. If not, the flow advances to Step S81 whereat the read event is neglected or does not converted to return to the main routine (FIG. 4). If there is no coincident conversion rule, designation whether conversion is executed or not may be provided.

If there is a coincident conversion rule, the flow advances to Step S73 for the conversion with the searched detected conversion rule.

At Step S73 the data string data1 is converted into the data string data2 or data3 in accordance with the type of the automatic performance data, and the converted data string is recorded in the converted file. For example, in accordance with the conversion rule given by the equation (3), the type1 is converted into the type 2 as shown in the equation (2) and the converted results are recorded in the converted file. Thereafter, the flow returns to the main routine (FIG. 4).

Depending upon the conversion rule, efficient conversion may be executed by using the registers REG1 and REG2 or table RevTbl and by referring to variables and arrays.

The melody tone color process has been described above. Next, the drum tone color process will be described.

[2] Drum Tone Color (1) Bank Select

The bank select is executed in a similar manner to the melody tone color process described above.

As different from a melody tone color, the drum tone color is not necessary to designate a tone pitch. For example, a bass drum produces only a single tone pitch so that designation of the tone pitch is unnecessary. The tone color designating method for a drum tone color is therefore different from the melody tone color.

The melody tone color is designated by a bank number (bank select) and a program number (program change) and its tone pitch is designated by the note number in the note event. For the drum tone color, a drum set is designated by a bank number and a program number, and a part in the drum set is designated by the note number in the note event. The drum tone color is therefore substantially designated by a bank number, a program number, and a note number.

(2) Program Change

It is assumed that a program change is read from the converting file. If the read event is a program change, the flow advances to Step S22 via Step S21.

At Step S22 it is checked whether the bank number designated by the bank select is a drum bank or a melody band. In this example, the drum tone color is assumed as being designated. For the drum tone color, the flow advances to Step S31.

At Step S31, the program number corresponding to the read program change is stored in the internal register. Although the program number is stored in the internal register, it is not written in the converted file. The program number is written in the converted file when the note event is read later (S45).

At Step S32, with reference to the channel information table formed at Step S6 shown in FIG. 4, the channel of the drum tone color is divided if necessary to reserve a plurality of divided channels and form a correspondence table between program numbers and channel numbers.

The channel information table is a table for storing channel numbers used by the converting file. The correspondence table between program numbers and channel numbers is used for judging at Step S42 whether the concerned channel is a drum tone color channel or a melody tone color channel.

Although the converting file reserves one channel per one program change (program name), the converted file reserves a plurality of channels per one program change. The reason for this will be described.

For the drum tone color, a drum set is designated by a bank number and a program number. After the drum set is once designated, it is quite seldom to change the drum set. After the drum set is designated, a part of the drum is selected by changing the note number.

However, even if all parts are presumably contained in one drum set in the converting type, these parts are contained in a plurality of drum sets in the converted type in some cases. Although the drum set may be changed each time the part changes, it may happen that sounds in the drum set now being reproduced are changed in the midst of reproduction if the drum set is changed. It is desired that even if the drum set is changed, sound presently reproduced continues to be generated from the previous drum set.

In order to solve this problem, if one drum set is designated in the converting type, then the converted type reserves a plurality of channels necessary for producing sounds of a plurality of drum sets. However, if the drum set in the converting type contains both the drum and melody tone colors in the converted type, it is necessary to reserve a plurality of channels for reproducing sounds of both drum and melody tone colors.

If the converting and converted types are known beforehand, it is possible to know a minimum number of channels to be reserved when a drum set is designated. For example, if a drum set is designated in one converting type, six channels are reserved for reproducing sounds of four drum sets and two melody sets. This means that each part contained in the drum set in the converting type covers six tone color sets after the conversion. In other words, converting channel information is divided into a plurality of channel information pieces to generate converted channel information pieces.

If the number of channels is insufficient and necessary channels cannot be reserved at Step S32, information on the channels not reserved is stored in the correspondence table at Step S33. When a note event using such a channel is read later, the note event in addition to a code indicating inability of sound reproduction can be written in the converted file. Although the note event of this channel cannot be reproduced, a desired process can be performed by editing it with a sequencer or a computer. For example, this channel number may be changed to another channel number which can produce sounds. After recording into the correspondence table, the flow returns to the main routine (FIG. 4).

(3) Note Event

It is assumed that a note event is read from the converting file. If the read event is a note event, the flow advances to Step S42 via Steps S21 and S41.

At Step S42 it is checked whether the channel of the note event is a drum assign channel. This check is performed basing upon the table formed at Step S32. In this example, the drum tone color is assumed as being assigned. Since the channel for the drum tone color is a drum assign channel, the flow advances to Step S43.

At Step S43 the converted bank number, program number and note number are obtained in accordance with the stored bank number (S62), program number (S31) and note number in the designated note event.

Specifically, the rhythm tone color conversion table 4*e* (FIG. 2) is used to obtain the converted bank number, program number and note number.

At Step S44, in accordance with the stored bank number (S62), program number (S31) and note number in the designated note event, a velocity table for the tone color is obtained. Specifically, the velocity conversion table 4*f* (FIG. 2) is used to obtain converted velocities.

At Step S45 the correspondence table (formed at S33) is referred to in accordance with the converted program change (program number) to thereby check whether it is possible to assign a channel. If possible, the converted bank number, program number and note number as well as the converted velocity are recorded in the converted file as the channel information.

The correspondence table (S33) stores therein the information of channels not reserved when the drum tone color channel was divided. Therefore, by referring to the correspondence table, it is possible to check whether it is possible to assign a channel. If possible, the converted bank number, program number and the like are recorded to thereafter return to the main routine (FIG. 4).

In the case of the drum tone color, a drum set is designated by the bank number and program number, and a part in the drum set is designated by the note number.

(4) Others (e.g., effect imparting)

Similar processes for the melody tone color are used for other events. If effects such as pitch vending are imparted to a channel assigned a drum tone color, the effects are imparted to all channels divided for the drum tone color, by referring to the correspondence table formed at Step S32.

According to this embodiment, automatic performance data can be converted not only for a melody tone color but also for a drum tone color. If the conversion table is used, conversion of numerical data such as tone colors and velocities can be performed. If the conversion rules are used additionally, complicated conversions can be performed which are otherwise impossible or difficult by only the conversion table. A user can write a conversion table with a low level programming language of a text format so that the conversion rule can be formed easily.

A user or a maker can form or change the conversion rule or table. Since a user or a maker can freely form or change a conversion rule, the rule of automatic performance data conversion can be determined with ease and the degree of freedom of automatic performance data conversion can be widened.

Effect imparting data contained in automatic performance data can also be converted into a different type. Even if there is no compatibility between effect imparting data in converting and converted automatic performance data, it is possible to properly convert the effect imparting data from one type into another type. Proper effects can be imparted to musical tone signals by supplying the automatic performance data with the converted effect imparting data to an effect imparting apparatus.

Although one channel information piece is sufficient in the converting automatic performance data, a plurality of channel information pieces are sometimes required in the converted automatic performance data, as in the case of a drum tone color. In such a case, the single channel information piece in the converting automatic performance data is divided into a plurality of channel information pieces to generate the converted automatic performance data. By dividing into a plurality of channel information pieces, the converted automatic performance data can be properly played. In this manner, correct sound reproduction is possible both for the melody and drum tone colors.

The automatic performance data conversion system of this embodiment can convert automatic performance data used by karaoke sing-along machines, automatic performance data used by electronic musical instruments, automatic performance data composed of only MIDI data, and the like.

For data conversion, it is not necessary to write all conversion rules or tables, but some conversion rules or tables may be used only for particular categories when specifically instructed, and default conversion is executed unless specifically instructed.

For example, it is not necessarily required to prepare a conversion rule or table for each tone color (program change), but velocities may be converted by using a representative conversion rule or table.

Automatic performance data conversion may be executed by a computer or in an electronic musical instrument itself.

Automatic performance data before and after conversion may be supplied to an automatic performance data conversion system through network communications, without using the data in the form of storage media such as floppy disks.

The present invention has been described in connection with the preferred embodiments. The invention is not limited only to the above embodiments. It is apparent that various modifications, improvements, combinations, and the like can be made by those skilled in the art.

What is claimed is:

1. An automatic performance data conversion system comprising:

a storage medium storing a computer executable rule for converting automatic performance data from a first type into a second type, said rule indicating a correspondence between data strings of the automatic performance data of the first and second types;

an input device for inputting the automatic performance data of the first type;

a converter for converting the automatic performance data from the first type into the second type by rearranging a data string contained in the automatic performance data of the first type input by said device in accordance with said rule, wherein said converter is capable of generating the automatic performance data of the second type by converging data values contained in the automatic performance data of the first type; and an output device for outputting the automatic performance data of the second type converted by said converter.

2. An automatic performance data conversion system according to claim 1, wherein said converter generates the automatic performance data of the second type containing information indicating a failure of proper rearrangement of the data string if the data string cannot be properly rearranged.

3. An automatic performance data conversion system according to claim 1, wherein said storage medium stores a velocity table for each tone color and said converter converts a velocity value for each tone color by referring to the velocity table.

4. An automatic performance data conversion system according to claim 1, wherein said storage medium stores a volume table for each tone color and said converter converts an offset value of volume for each tone color by referring to the volume table.

5. An automatic performance data conversion system according to claim 1, wherein said data values are values of each tone volume in said automatic performance data.

6. An automatic performance data conversion system according to claim 1, wherein said data values are values of musical tone elements other than data of tone colors.

7. An automatic performance data conversion system comprising:

a storage medium storing a computer executable rule for converting automatic performance data from a first type into a second type, said rule indicating a correspondence between data strings of the automatic performance data of the first and second types;

an input device for inputting the automatic performance data of the first type;

a converter for converting the automatic performance data from the first type into the second type by rearranging a data string contained in the automatic performance data of the first type input by said input device in accordance with said rule, wherein said converter converts the automatic performance data from the first type into the second type by rearranging an effect imparting data string contained in the automatic performance data of the first type; and an output device for outputting the automatic performance data of the second type converted by said converter.

8. An automatic performance data conversion system comprising:

a storage medium storing a computer executable rule for converting automatic performance data from a first type into a second type, said rule indicating a correspondence between data strings of the automatic performance data of the first and second types;

an input device for inputting the automatic performance data of the first type;

a converter for converting the automatic performance data from the first type into the second type by rearranging a data string contained in the automatic performance data of the first type input by said input device in accordance with said rule;

an output device for outputting the automatic performance data of the second type converted by said converter; and an entry device for forming or changing said rule stored in said storage medium.

9. An automatic performance data conversion system comprising:

a storage medium storing a computer executable rule for converting automatic performance data from a first type into a second type, said rule indicating a correspondence between data strings of the automatic performance data of the first and second types;

an input device for inputting the automatic performance data of the first type;

a converter for converting the automatic performance data from the first type into the second type by rearranging a data string contained in the automatic performance data of the first type input by said input device in accordance with said rule, wherein said converter generates the automatic performance data of the second type by neglecting or not converting the data string if said rule necessary for conversion is not stored in said storage medium; and an output device for outputting the automatic performance data of the second type converted by said converter.

10. An automatic performance data conversion system comprising:

a storage medium storing a computer executable rule for converting automatic performance data from a first type into a second type, wherein said rule determines a conversion type and a correspondence between data strings contained in the automatic performance data of the first and second types;

an input device for inputting the automatic performance data of the first type;

a converter for converting the automatic performance data from the first type into the second type by rearranging a data string contained in the automatic performance data of the first type input by said input device in accordance with said rule;

an output device for outputting the automatic performance data of the second type converted by said converter.

11. An automatic performance data conversion system comprising:

a storage medium storing a computer executable rule for converting automatic performance data from a first type into a second type, said rule indicating a correspondence between data strings of the automatic performance data of the first and second types;

an input device for inputting the automatic performance data of the first type;

a converter for converting the automatic performance data from the first type into the second type by rearranging a data string contained in the automatic performance data of the first type input by said input device in accordance with said rule;

an output device for outputting the automatic performance data of the second type converted by said converter;

a designating device for designating a type of the automatic performance data of the first type; and a detector for detecting a type of the input automatic performance data of the first type, wherein said converter does not generate the automatic performance data of the second type if the type designated by said designating device and the type detected with said detector are the same.

12. An automatic performance data conversion system comprising:

a storage medium storing a computer executable rule for converting automatic performance data from a first type into a second type, said rule indicating a correspondence between data strings of the automatic performance data of the first and second types;

an input device for inputting the automatic performance data of the first type;

a converter for converting the automatic performance data from the first type into the second type by rearranging a data string contained in the automatic performance data of the first type input by said input device in accordance with said rule;

an output device for outputting the automatic performance data of the second type converted by said converter;

a designating device for designating a type of the automatic performance data of the first type; and a detector for detecting a type of the automatic performance data of the first type, wherein said converter does not generate the automatic performance data of the second type if the type designated by said designating device and the type detected with said detector are the same, wherein said detecting means detects the type by receiving a reset signal contained in the automatic performance data of the first type.

13. An automatic performance data conversion system comprising:

an input device for inputting automatic performance data of a first type;

a converter for converting the automatic performance data of the first type input by said input device into automatic performance data of a second type by dividing a single channel information piece contained in the automatic performance data of the first type into a plurality of channel information pieces; and an output device for outputting the automatic performance data of the second type converted by said converter.

14. An automatic performance data conversion method comprising the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule, wherein said step (c) includes a step of generating the automatic performance data of the second type by converging data values contained in the automatic performance data of the first type; and (d) outputting a converted automatic performance data of the second type.

15. An automatic performance data conversion method according to claim 14, wherein said step (c) generates the automatic performance data of the second type containing information indicating a failure of proper rearrangement of the data string if the data string cannot be properly rearranged.

16. An automatic performance data conversion method according to claim 14, wherein said storage means stores a velocity table for each tone color and said step (c) converts a velocity value for each tone color by referring to the velocity table.

17. An automatic performance data conversion method according to claim 14, wherein said storage means stores a volume table for each tone color and said step (c) converts an offset value of volume for each tone color by referring to the volume table.

18. An automatic performance data conversion method according to claim 14, wherein said data values are values of each tone volume in said automatic performance data.

19. An automatic performance data conversion method according to claim 14, wherein said data values are values of musical tone elements other than data of tone colors.

20. An automatic performance data conversion method comprising the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule, wherein said step (c) converts the automatic performance data from the first type into the second type by rearranging an effect imparting data string contained in the automatic performance data of the first type; and (d) outputting a converted automatic performance data of the second type.

21. An automatic performance data conversion method comprising the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule;

(d) outputting a converted automatic performance data of the second type; and (e) forming or changing the rule stored in said storage means.

22. An automatic performance data conversion method comprising the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule, wherein said step (c) generates the automatic performance data of the second type by neglecting or not converting the data string if the rule necessary for conversion is not stored in said storage means; and (d) outputting a converted automatic performance data of the second type.

23. An automatic performance data conversion method comprising the steps of:

(a) preparing storage means for storing a rule for converting automatic performance data from a first type into a second type, wherein the rule determines a conversion type and a correspondence between data strings contained in the automatic performance data of the first and second types;

(b) inputting the automatic performance data of the first type;

(c) converting the automatic performance data from the first type into the second type by rearranging a data string contained in the automatic performance data of the first type in accordance with said rule; and (d) outputting a converted automatic performance data of the second type.

24. An automatic performance data conversion method comprising the steps of:

(a) preparing storage means for storing a rule for converting automatic performance data from a first type into a second type, said rule indicating a correspondence between data strings of the automatic performance data of the first and second types;

(b) designating a type of the automatic performance data of the first type;

(c) inputting the automatic performance data of the first type;

(d) detecting a type of the automatic performance data of the first type, (e) converting the automatic performance data from the first type into the second type by rearranging a data string contained in the automatic performance data of the first type in accordance with said rule, wherein said step (e) does not generate the automatic performance data of the second type if the type designated at said step (b) and the type detected at said step (d) are the same; and (f) outputting a converted automatic performance data of the second type.

25. An automatic performance data conversion method according to claim 24, wherein said step (d) detects the type by receiving a reset signal contained in the automatic performance data of the first type.

26. An automatic performance data conversion method comprising the steps of:

(a) inputting automatic performance data of a first type;

(b) converting the input automatic performance data of the first type into automatic performance data of a second type by dividing a single channel information piece contained in the automatic performance data of the first type into a plurality of channel information pieces; and (c) outputting the converted automatic performance data of the second type.

27. A medium storing a computer executable program, the program comprising instructions for causing a machine to perform the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule, wherein said step (c) includes a step of generating the automatic performance data of the second type by converging data values contained in the automatic performance data of the first type; and (d) outputting a converted automatic performance data of the second type.

28. A medium storing a computer executable program according to claim 27, wherein said procedure (c) generates the automatic performance data of the second type containing information indicating failure of proper rearrangement of the data string if the data string cannot be properly rearranged.

29. A medium storing a computer executable program according to claim 27, wherein said storage means stores a velocity table for each tone color and said procedure (c) converts a velocity value for each tone color by referring to the velocity table.

30. A medium storing a computer executable program according to claim 27, wherein said storage means stores a volume table for each tone color and said procedure (c) converts an offset value of volume for each tone color by referring to the volume table.

31. A medium storing a computer executable program according to claim 27, wherein said data values are values of each tone volume in said automatic performance data.

32. A medium storing a computer executable program according to claim 27, wherein said data values are values of musical tone elements other than data of tone colors.

33. A medium storing a computer executable program, the program comprising instructions for causing a machine to perform the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule, wherein said step (c) converts the automatic performance data from the first type into the second type by rearranging an effect imparting data string contained in the automatic performance data of the first type; and (d) outputting a converted automatic performance data of the second type.

34. A medium storing a computer executable program, the program comprising instructions for causing a machine to perform the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule;

(d) outputting a converted automatic performance data of the second type; and (e) forming or changing the rule stored in said storage means.

35. A medium storing a computer executable program, the program comprising instructions for causing a machine to perform the steps of:

(a) preparing storage means for storing a rule for converting automatic performance data from a first type into a second type, said rule indicating a correspondence between data strings of the automatic performance data of the first and second types;

(b) inputting the automatic performance data of the first type;

(c) converting the automatic performance data from the first type into the second type by rearranging a data string contained in the automatic performance data of the first type in accordance with said rule, wherein said step (c) generates the automatic performance data of the second type by neglecting or not converting the data string if the rule necessary for conversion is not stored in said storage means; and (d) outputting a converted automatic performance data of the second type.

36. A medium storing a computer executable program, the program comprising instructions for causing a machine to perform the steps of:

(a) preparing storage means for storing a rule for converting automatic performance data from a first type into a second type, said rule determines a conversion type and a correspondence between data strings contained in the automatic performance data of the first and second types;

(b) inputting the automatic performance data of the first type;

(c) converting the automatic performance data from the first type into the second type by rearranging a data string contained in the automatic performance data of the first type in accordance with said rule; and (d) outputting a converted automatic performance date of the second type.

37. A medium storing a computer executable program, the program comprising instructions for causing a machine to perform the steps of:

(a) preparing storage means for storing a rule for converting automatic performance data from a first type into a second type, said rule indicating a correspondence between data strings of the automatic performance data of the first and second types;

(b) designating a type of the automatic performance data of the first type;

(c) inputting the automatic performance data of the first type;

(c) detecting a type of the input automatic performance data of the first type;

(d) converting the automatic performance data from the first type into the second type by rearranging a data string contained in the automatic performance data of the first type in accordance with said rule, wherein said step (d) does not generate the automatic performance data of the second type if the type designated at said procedure (b) and the type detected at said procedure (c) are the same; and (e) outputting a converted automatic performance data of the second type.

38. A medium storing a computer executable program according to claim 37, wherein said procedure detects the type by receiving a reset signal contained in the automatic performance data of the first type.

39. A medium storing a computer executable program, the program comprising instructions for causing a machine to perform the steps of:

(a) inputting automatic performance data of a first type;

(b) converting the input automatic performance data of the first type into automatic performance data of a second type by dividing a single channel information piece contained in the automatic performance data of the first type into a plurality of channel information pieces; and (c) outputting the converted automatic performance data of the second type.

* * * * *